US006164526A

United States Patent [19]

Dalvey

[11] Patent Number: 6,164,526

[45] **Date of Patent: *Dec. 26, 2000**

[54] PAPER-BASED COOLER

[75] Inventor: Jodi A. Dalvey, 121 Washington Ave. South #816, Minneapolis, Minn. 55401

[73] Assignee: Jodi A. Dalvey, Orono, Minn.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/809,851

[22] PCT Filed: Oct. 13, 1995

[86] PCT No.: PCT/US95/12857

§ 371 Date: May 6, 1997

§ 102(e) Date: May 6, 1997

[87] PCT Pub. No.: WO96/11848

PCT Pub. Date: Apr. 25, 1996

Related U.S. Application Data

[63] Continuation-in-part of application No. 08/322,779, Oct. 13, 1994, Pat. No. 5,582,343.

[51] Int. Cl.[7] ..... B65D 5/46; B65D 5/56

[52] U.S. Cl. ..... 229/101; 53/468; 53/491; 62/457.5; 62/457.7; 206/427; 229/103; 229/117.15; 229/186

[58] Field of Search ..... 229/101, 103, 229/117.14, 229, 117.15, 186; 206/427, 435; 62/457.5, 457.7, 457.8, 457.9; 53/468, 491

[56] References Cited

U.S. PATENT DOCUMENTS

| | | | |
|---|---|---|---|
| 601,798 | 4/1898 | Slomka | 62/457.7 |
| 1,950,104 | 3/1934 | Ewers | 229/101 |
| 1,997,343 | 4/1935 | Qualgliotti | 229/186 |
| 2,008,443 | 7/1935 | Froehlig | 229/117.14 |
| 2,805,813 | 9/1957 | Rittmueller | 229/117.15 |
| 2,810,506 | 10/1957 | Kessler | 229/101 |
| 2,844,299 | 7/1958 | Kessler et al. | 62/457.5 |
| 2,979,227 | 4/1961 | Norton et al. | 62/457.5 |
| 3,934,587 | 1/1976 | Gordon | 229/3.1 |
| 4,328,923 | 5/1982 | Graser | 229/101 |
| 5,020,337 | 6/1991 | Krieg | 229/103 |
| 5,050,766 | 9/1991 | Groh | 229/3.1 |
| 5,074,460 | 12/1991 | Hanekamp | 229/117.15 |
| 5,094,359 | 3/1992 | DeMars et al. | 220/410 |
| 5,170,934 | 12/1992 | Lemoine | 229/240 |
| 5,263,339 | 11/1993 | Evans | 62/457.7 |
| 5,303,863 | 4/1994 | Arasim | 229/229 |
| 5,307,986 | 5/1994 | Schuster | 229/101 |
| 5,582,343 | 12/1996 | Dalvey | 229/101 |

*Primary Examiner*—Gary E. Elkins
*Attorney, Agent, or Firm*—Schwegman, Lundberg, Woessner & Kluth, P.A.

[57] ABSTRACT

A disposable and recyclable cooler (300) made of paper coated with a polymer. Some embodiments of the present invention transform from a first configuration that snugly retains a set of beverage containers to a second, expanded configuration that retains ice proximate the beverage containers.

23 Claims, 9 Drawing Sheets

FIG. 7
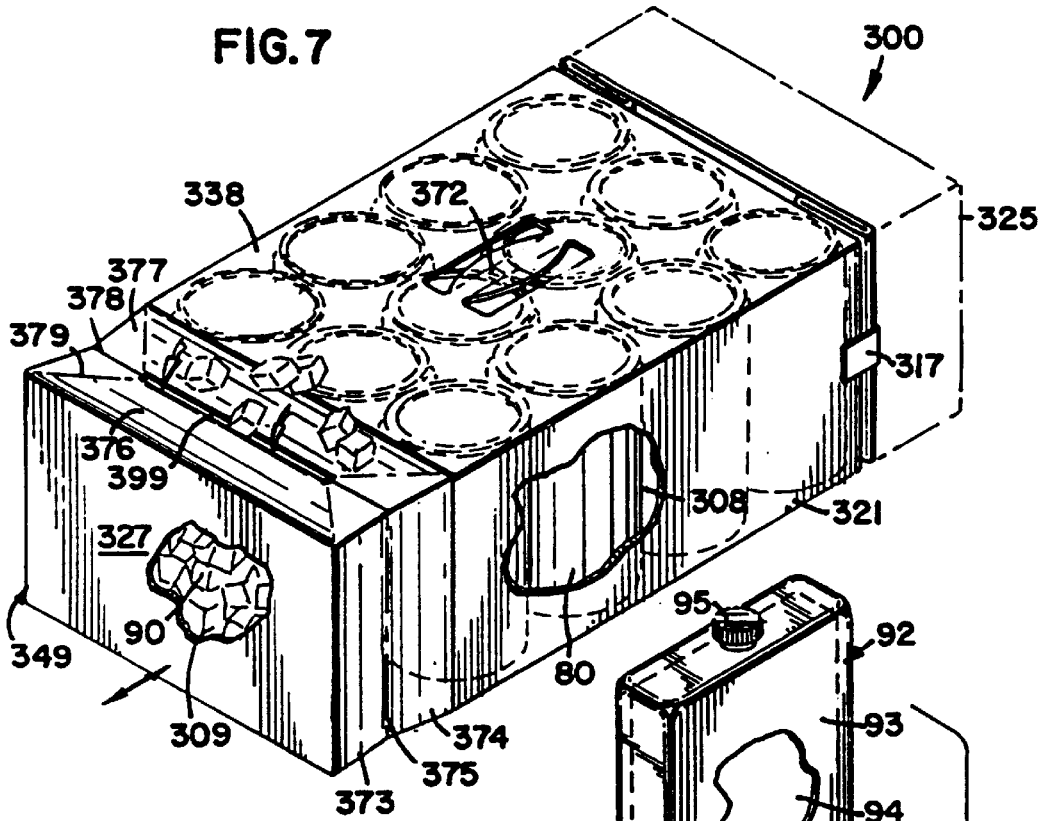
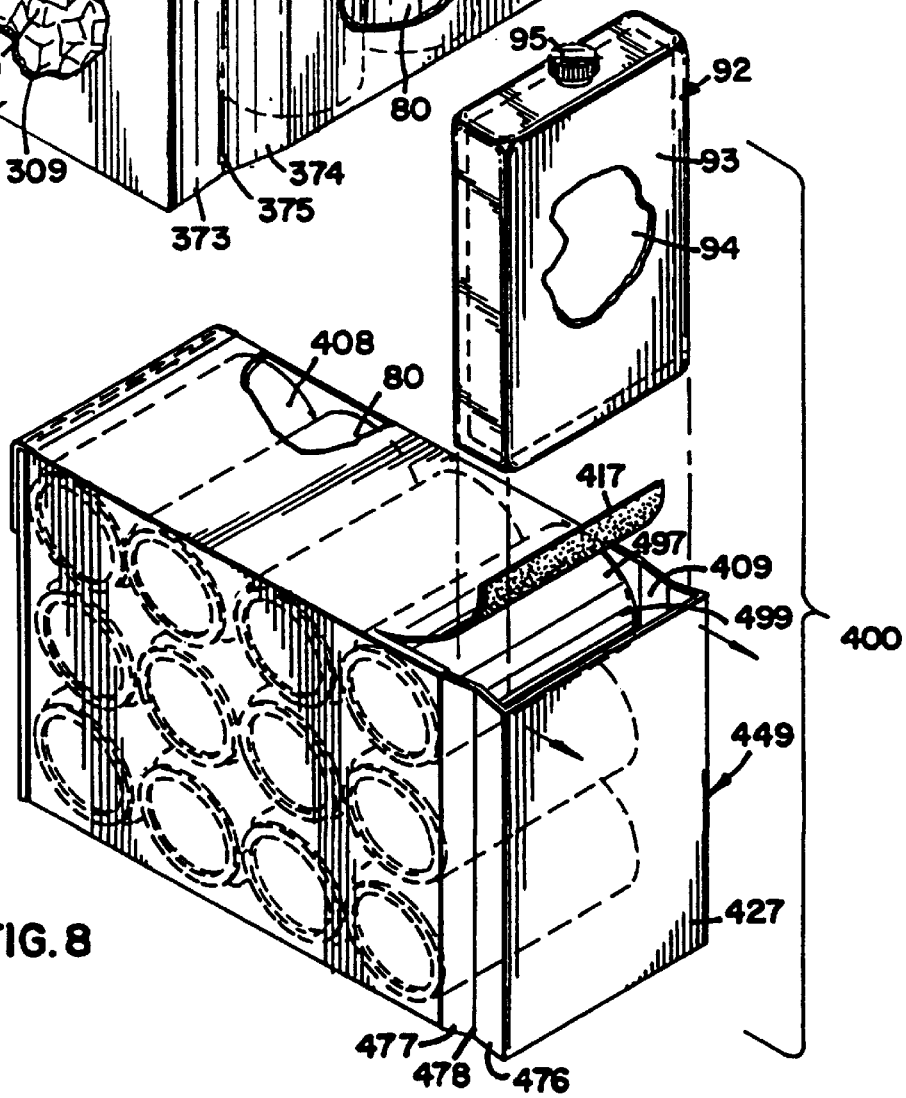
FIG. 8

PAPER-BASED COOLER

CROSS-REFERENCE TO RELATED APPLICATIONS

This application is a continuation-in-part application of U.S. Ser. No. 08/322,779 filed Oct. 13, 1994, which issued as U.S. Pat. No. 5,582,343 on Dec. 10, 1996.

FIELD OF THE INVENTION

The present invention relates to packaging methods and structures and in particular, to a substantially water tight carton made of paper that is coated with a polymer, and applicable in the fields of relatively short term storage and/or transportation of food, drink, medicine, etc. to be kept cooler than ambient temperature.

BACKGROUND OF THE INVENTION

The conventional cooler or ice box is one common solution to the need for storage and/or transportation of items to be cooled or kept cool relative to ambient temperature. A typical application for the conventional cooler is directed toward the desirability of having cool beverages at a remote location. The cooler is filled with a cooling source, such as ice, and the desired beverage(s), whether in cans, bottles, or other types of containers. The cooler satisfactorily insulates the items stored therein and thereby maintains the beverage(s) at a relatively cool temperature over the course of a day. However, the conventional cooler is nonetheless inconvenient in certain respects. For example, the conventional cooler is somewhat expensive to purchase; is relatively cumbersome to handle and store; and is typically unavailable for use on the spur of the moment. Thus, there exists room for improvement to known methods and apparatus for keeping items cooler than ambient temperature.

SUMMARY OF THE INVENTION

According to one aspect of the present invention, a sheet of paper is coated with a water sealant and subsequently folded into a carton capable of storing ice together with one or more items to be kept cooler than ambient temperature. The paper carton is relatively inexpensive to manufacture and distribute. The low cost of the paper carton and its amenability to being distributed in sheet form render the carton less cumbersome to handle and more conveniently made available for purchase through convenience stores and the like. The paper carton is also easy to use and readily disposable, as well, because the paper is repulpable despite the water proof coating.

According to another aspect of the present invention, an otherwise conventional carton for beverage containers is modified to be selectively expandable to accommodate ice or some other cooling source proximate the beverage containers. By incorporating the functional aspects of a conventional cooler or ice box into a case of beer, for example, the present invention eliminates altogether the need for a conventional cooler or ice box and the inconveniences associated therewith. These advantages of the present invention and others will become apparent from the description of the present invention that follows.

BRIEF DESCRIPTION OF THE DRAWING

With reference to the Figures of the Drawing, wherein like numerals represent like parts and assemblies throughout the several views.

FIG. 7 is an isometric view of an alternative embodiment carton constructed according to the principles of the present invention;

FIG. 8 is an isometric view of another alternative embodiment carton constructed according to the principles of the present invention;

DETAILED DESCRIPTION OF A PREFERRED EMBODIMENT

Figure 1:
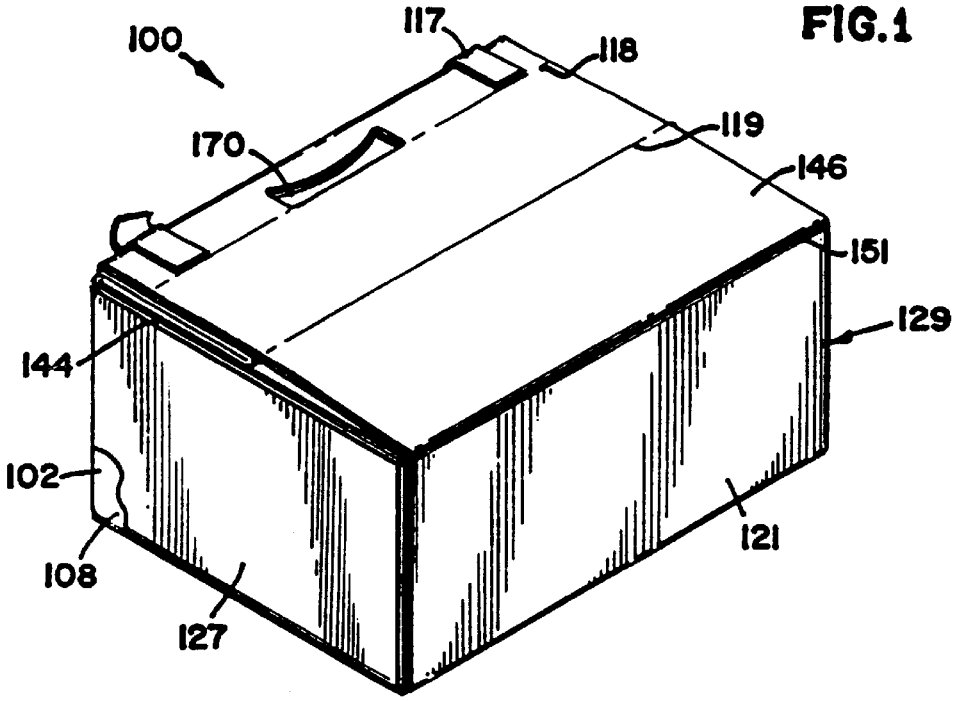
FIG. 1 is an isometric view of a preferred embodiment carton constructed according to the principles of the present invention, depicting the carton in a first configuration.
Figure 2:
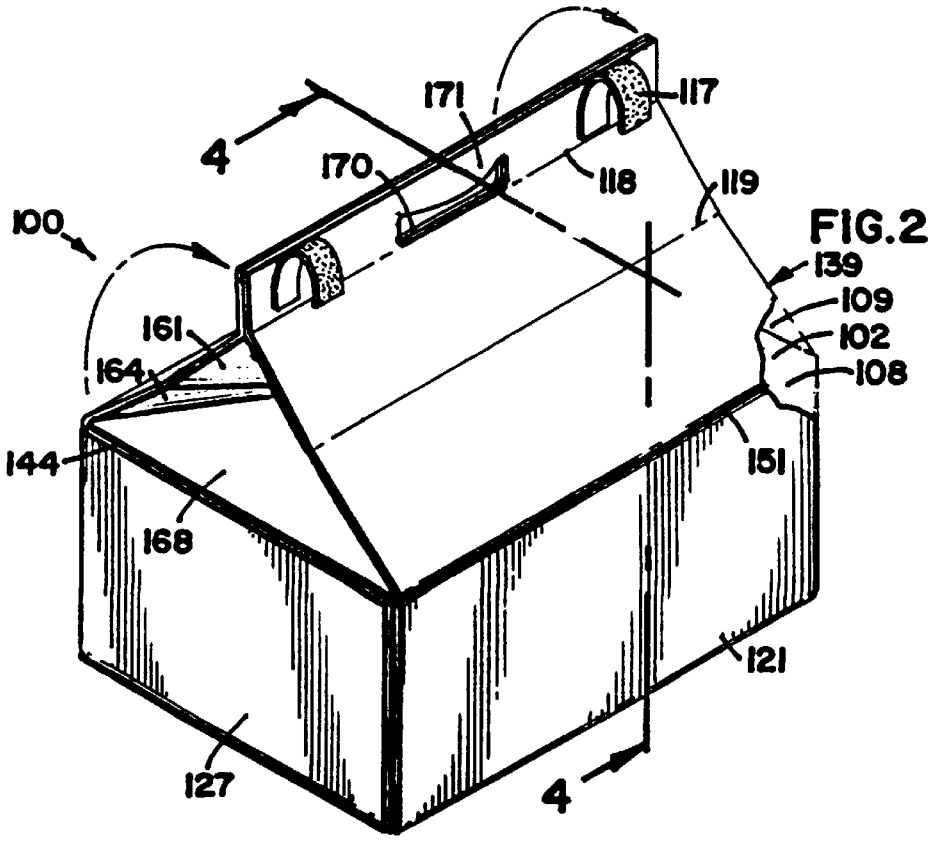
FIG. 2 is an isometric view of the carton shown in FIG. 1, depicting the carton in a second configuration having increased capacity.
Figure 3:
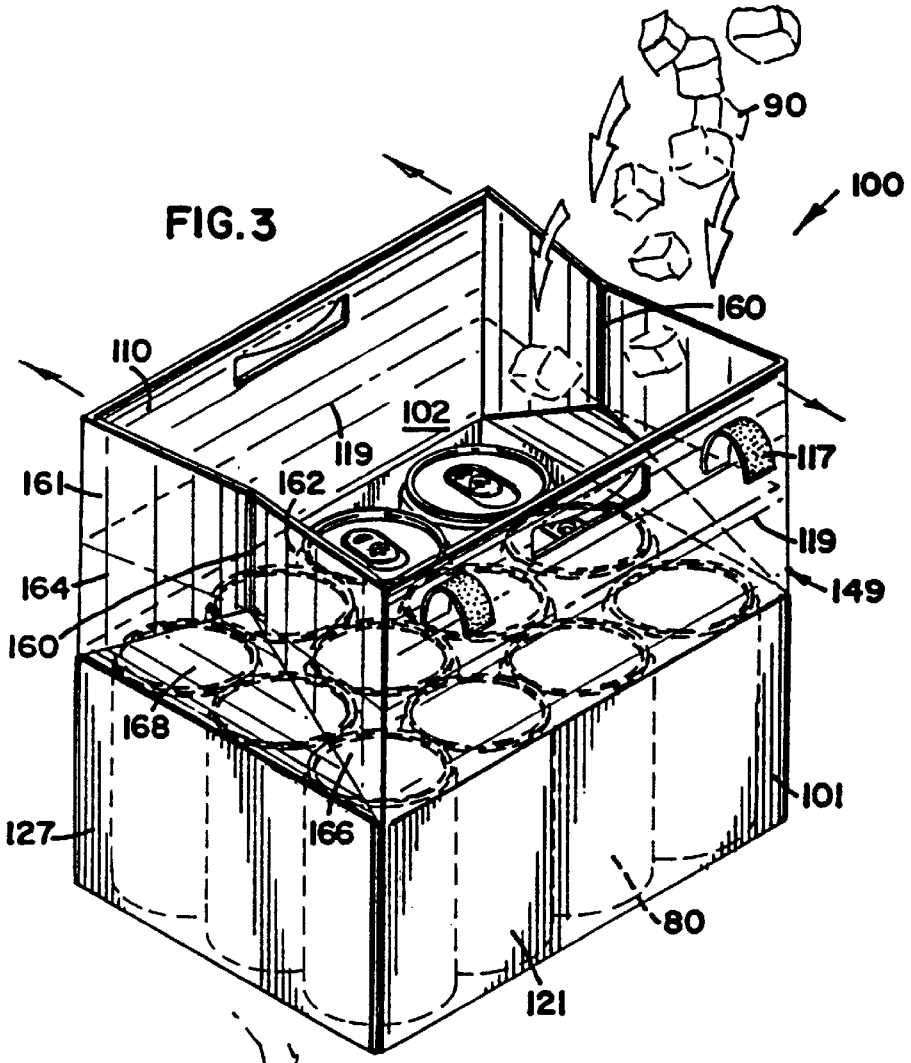
FIG. 3 is an isometric view of the carton shown in FIG. 2, depicting the carton in a third configuration providing access to containers packaged within the carton.

A preferred embodiment carton constructed according to the principles of the present invention is designated as 100 in FIGS. 1–5. As shown in FIG. 3, the carton 100 has an exterior surface 101 and an interior space 102 that is bounded by an interior surface 110. The carton 100 is assembled from a sheet of cardboard or card stock paper, such as those shown in FIGS. 5 and 6, respectively. The interior surface 110 of the paper carton 100 is coated with a water resistant material or sealant to enhance the structural integrity of the carton and make the carton effectively water tight when in an upright position. The preferred embodiment carton 100 is coated with a substance sold under the trademark PROTECOAT 3003 by NuCoat, LLC of Minneapolis, Minn. Although water resistant, the paper coated with PROTECOAT 3003 sealant is repulpable, as well. Although repulpability is a desirable attribute of the preferred embodiment carton 100, those skilled in the art will recognize that other water proof coatings, which are less amenable to repulsing, could be used without departing from the scope of the present invention.

In the carton configuration 129 shown in FIG. 1, the interior space 102 includes a First compartment 108 that accommodates beverage containers 80. In the carton configuration 139 shown in FIGS. 2 and 4, the Interior space 102 further includes a second compartment 109 that accommodates a cooling source, such as ice cubes 90, proximate the beverage containers 80. Although ice is well suited to this application because it is inexpensive and environmentally friendly, those skilled in the art will recognize that other cooling sources could be used in conjunction with the carton 100 without departing from the scope of the present invention.

Figure 5:
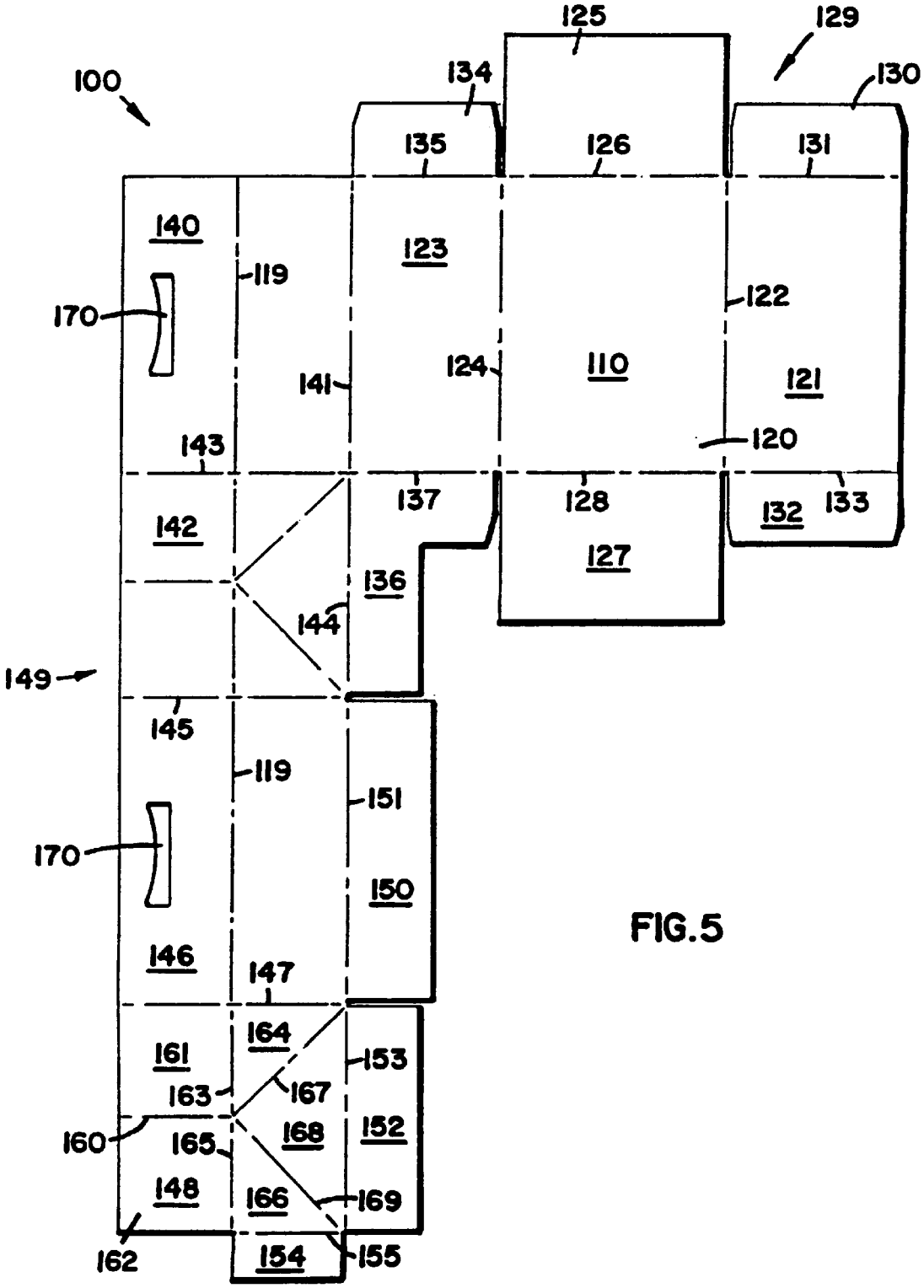
FIG. 5 is a plan view of a sheet of material that is manipulatable into the carton shown in FIGS. 1–4.

As shown in FIG. 5, the sheet of cardboard 100 includes portions which may be characterized as a bottom wall 120, a first side wall 121, a second side wall 123, a first end wall 125, and a second end wall 127. These portions cooperate to define the shape of the first carton configuration 129, which is a rectangular parallelepiped having dimensions suitable for snugly retaining twelve twelve-ounce beverage cans 80 arranged side by side in a three by four array within the first compartment 108. In this first configuration 129 of the preferred embodiment, adjacent cans 80 are retained in contact with one another to maximize stability of the cans 30 during shipping and handling of the carton 100, and thereby minimize disruption of the contents of the cans 80.

The bottom wall 120 and the first side wall 121 are integrally joined to one another along fold line 122. The bottom wall 120 and the second side wall 123 are integrally joined to one another along fold line 124. The bottom wall 120 and the first end wall 125 are integrally joined to one another along fold line 126. The bottom wall 120 and the second end wall 127 are integrally joined to one another along fold line 128. The fold lines 122 and 124 are substantially parallel to one another, as are the fold lines 126 and 128. The fold lines 122 and 124 are substantially perpendicular to the fold lines 126 and 128.

A first corner flap 130 is integrally joined to the first side wall 121 along fold line 131, which is co-linear with fold line 126. A second corner flap 132 is integrally joined to the first side wall 121 along fold line 133, which is co-linear with fold line 128. Assembly of the sheet 100 into the carton 100 requires folding of the corner flaps 130 and 132 relative to the first side wall 121, along respective fold lines 131 and 133, and toward the interior surface 110 of the carton 100. Also, the first side wall 121 is folded relative to the bottom wall 120, along fold line 122, and toward the interior surface 110.

A third corner flap 134 is integrally joined to the second side wall 123 along fold line 135, which is co-linear with fold line 126. A fourth corner flap 136 is integrally joined to the second side wall 123 along fold line 137, which is co-linear with fold line 128. Assembly of the carton 100 further requires folding of the corner flaps 134 and 136 relative to the second side wall 123, along respective fold lines 135 and 137, and toward the interior surface 110 of the carton 100. Also, the second side wall 123 is folded relative to the bottom wall 120, along fold line 124, and toward the interior surface 110. At this point in the assembly process, the interior surfaces of the side walls 121 and 123 generally face one another, as do the interior surfaces of the first and second corner flaps 130 and 132, and the interior surfaces of the third and fourth corner flaps 134 and 136.

Adhesive is applied to the exterior surfaces of the corner flaps 130, 132, 134, and 136, the interior surfaces of the end walls 125 and 127, or both. The end walls 125 and 127 are then folded relative to the bottom wall 120, along respective fold lines 126 and 128, and toward the interior surface 110 of the carton 100. The adhesive secures the corner flaps 130 and 134 to the end wall 125, and the corner flaps 132 and 136 to the end wall 127, thereby forming the rectangular parallelepiped box 129 shown in FIG. 1.

The sheet of cardboard 100 further includes portions which may be characterized as a first side wall extension or handle panel 140, a second side wall extension or handle panel 146, a first end wall extension or hinge member 142, and a second end wall extension or hinge member 148. These portions cooperate to enclose the second compartment 109 and are sized and configured to retain ice 90 above the beverage containers 80 in the first compartment 108. These portions combine with the box 129 to define the shape of the closed carton configuration 139 shown in FIGS. 2 and 4.

The first handle panel 140 and the second side wall 123 are integrally joined to one another along fold line 141, which is parallel and opposite the fold line 124 between the bottom 120 and the second side wall 123. The first handle panel 140 and the first hinge member 142 are integrally joined to one another along fold line 143, which is co-linear with the fold line 137 and perpendicular to fold line 141. The first hinge member 142 and the second handle panel 146 are integrally joined to one another along fold line 145, which is parallel to the fold line 143. The first hinge member 142 is also integrally joined to the fourth corner flap 136 along the fold line 144, which is co-linear with the fold line 141.

A first adjoining flap 150 is integrally joined to the second handle panel 146 along fold line 151, which is co-linear with the fold line 144. The second handle panel 146 is also integrally joined to the second hinge member 148 along fold line 147, which is parallel to the fold line 145. A second adjoining panel 152 is integrally joined to the second hinge member 148 along fold line 153, which is co-linear with the fold line 151. Also, a fifth corner flap 154 is integrally joined to the second hinge member 148 along fold line 155, which is perpendicular to the fold line 153.

Assembly of the carton 100 requires folding of the first handle panel 140 relative to the second side wall 123, along the fold line 141, and toward the interior surface 110 of the carton 100, and likewise folding of: the first hinge member 142 relative to the fourth corner flap 136, along the fold line 144; the second handle panel 146 relative to the first adjoining flap 150, along the fold line 151; and the second hinge member 148 relative to the second adjoining flap 152, along the fold line 153. The first hinge member 142 is folded relative to the first handle panel 140, along the fold line 143; the second handle panel 146 is folded relative to the first hinge member 142, along the fold line 145; the second hinge member 148 is folded relative to the second handle panel 146, along the fold line 147; and the fifth corner flap 154 is folded relative to the second hinge member 148, along the fold line 155, all folds bringing interior surfaces toward one another.

Adhesive is applied to the exterior surfaces of the fourth and fifth corner flaps 136 and 154 and to the exterior surfaces of the adjoining flaps 150 and 152 to secure portions of the upper compartment relative to adjacent, non-integral portions of the upper compartment and lower compartment, and thereby secure the sheet 100 into the carton configuration 149 shown in FIG. 3.

Each of the hinge members 142 and 148 includes an adjacent pair of upper square portions 161 and 162 which are integrally joined along fold line 160. The square portions 161 and 162 define a first rectangular area approximately equal in size and shape to a second rectangular area that is segregated into three isosceles right triangles. One of the shorter sides of the first triangle 164 is integrally joined to the first square portion 161, along fold line 163, and the other shorter side shares the fold line 147 with the second handle panel 146. One of the shorter sides of the second triangle 166 is integrally joined to the second square portion 162, along fold line 165, and the other shorter side shares the fold line 155 with the fifth corner flap 155.

The third triangle 168 is twice as large as each of the first triangle 164 and the second triangle 166. The hypotenuse of the first triangle 164 is integrally joined to one of the shorter sides of the third triangle 168, along fold line 167. The hypotenuse of the second triangle 166 is integrally joined to the other shorter side of the third triangle 168, along fold line 169. The hypotenuse of the third triangle 168 shares the fold line 153 with the second adjoining panel 152.

Figure 4:
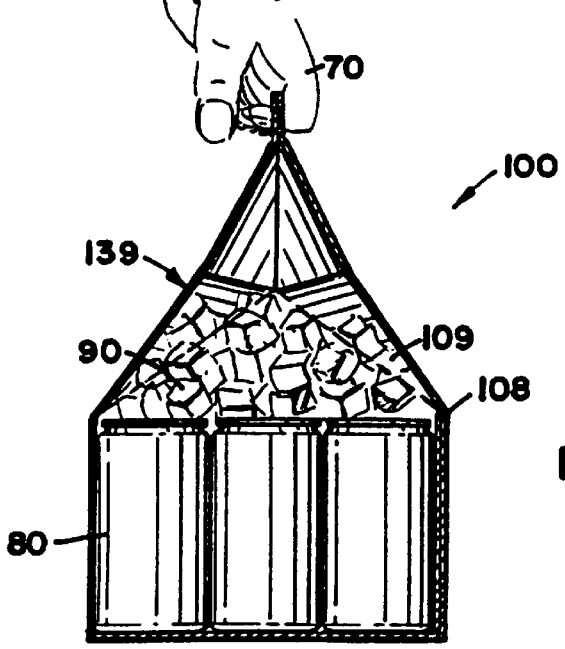
FIG. 4 is a sectioned side view of the carton shown in FIG. 2, depicting beverage containers and ice packaged within the carton.

The operation of the hinge members 142 and 148 is perhaps best described with reference to FIGS. 2 and 3, as well as FIG. 5. Movement of opposing fold lines 160 toward one another causes each pair of adjacent squares 161 and 162 to fold toward one another and causes the handle panels 140 and 146 to move toward one another. Each pair of smaller triangles 164 and 166 folds toward a respective larger triangle 168, and each larger triangle 168 folds toward the lower compartment 108 to accommodate movement of the handle panels 140 and 146 toward one another. As the handle panels 140 and 146 converge, one can easily bring upper portions 171 thereof together and proceed to secure the carton in the second configuration 139 by securing the handles panels relative to one another by means of adhesive strips 117, as shown in FIG. 2, and/or by inserting one or more digits 70 through aligned openings 170 in the handle panels, as shown in FIG. 4. Fold lines 118 extend across the handle panels 140 and 146 just beneath the handle openings 170 to facilitate abutment of the upper portions 171 thereof.

Fold lines 119 extend across the handle panels 140 and 146 and are co-linear with the fold lines 163 and 165 on the hinge members 142 and 148. In the preferred embodiment carton 100 shown in FIG. 1, the fold line 119 across the panel 140 facilitates folding of the handle panel 140 back against itself to arrive at the carton configuration 129. In this configuration 129, the exterior surfaces of each pair of smaller triangles 164 and 166 face the exterior surface of a respective larger triangle 168, and the squares 161 and 162 face one another. The handle panel 146 substantially covers the other upper compartment components, as well as the lower compartment 108, where the beverage containers 80 are stored in much the same manner (including size and configuration) as in conventional cartons for beverage containers.

A consumer in possession of the carton 100 has the option of using the carton as a cooler or ice box. He or she simply (1) peels or cuts the tape 117 from the carton configuration 129 shown in FIG. 1; (2) unfolds the handle panels 140 and 146 to arrive at the carton configuration 139 shown in FIG. 2; (3) separates the handle panels 140 and 146 to arrive at the carton configuration 149 shown in FIG. 3; (4) places ice 90 on top of the beverage cans 80; and (5) brings the upper portions 171 of the handle panels 140 and 146 back into abutment to arrive at the carton configuration 139 shown in FIG. 4. Those skilled in the art will recognize that the preferred embodiment carton 100 requires relatively few changes to existing cartons for beverage containers and the processes of making and using same, and does add substantially to the bulk of such cartons.

Figure 6:
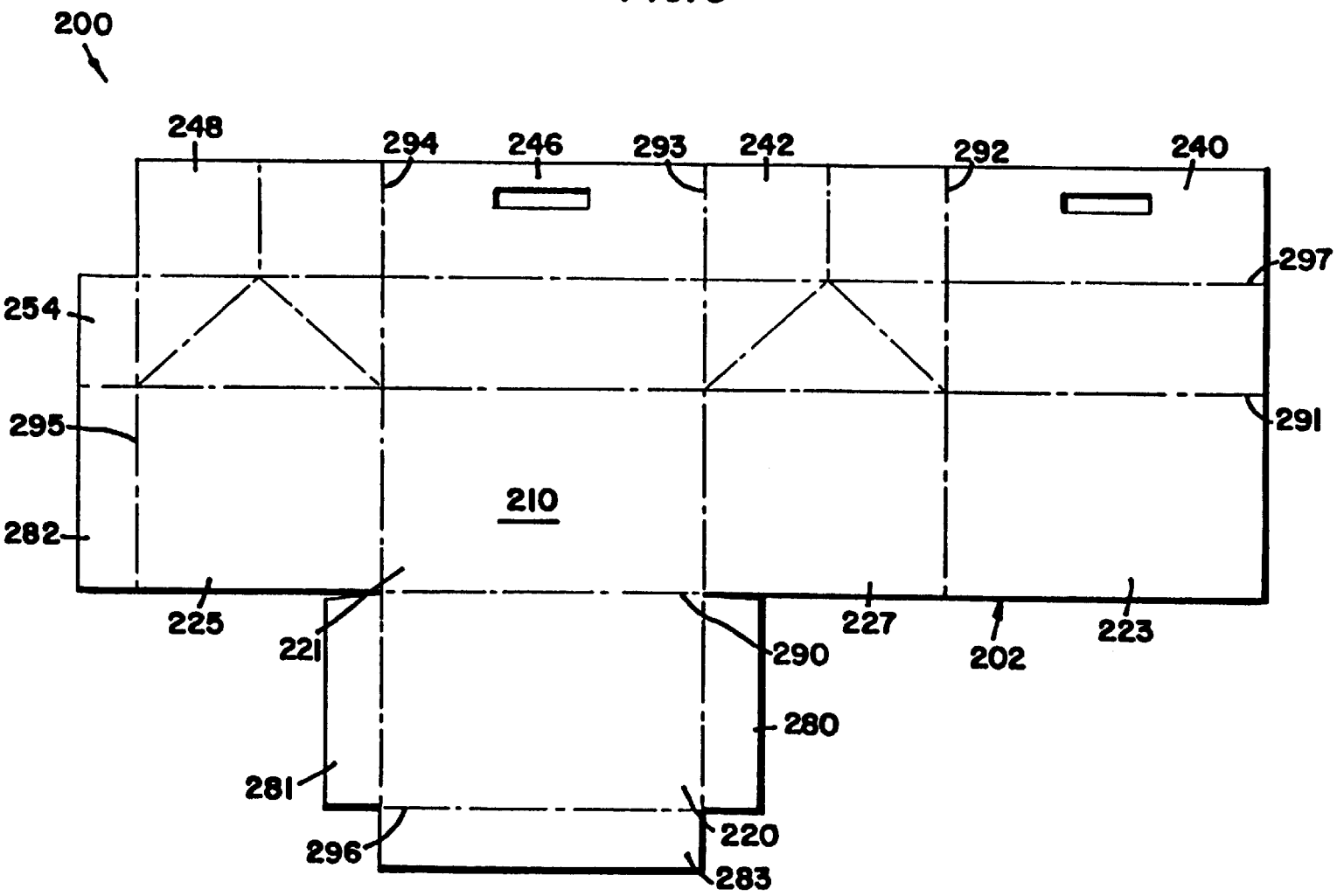
FIG. 6 is a plan view of another sheet of material that is manipulatable into the carton shown in FIGS. 1–4.

As shown in FIG. 6, the alternative sheet of card stock paper 200 similarly includes portions which may be characterized as a bottom wall 220, a first side wall 221, a second side wall 223, a first end wall 225, and a second end wall 227. Like their counterparts on the sheet 100 shown in FIG. 5, these portions cooperate to define a first compartment sized and configured to snugly retain twelve twelve-ounce beverage cans arranged side by side in a three by four array. The cardboard sheet 200 further includes portions which may be characterized as a first handle panel 240, a second handle panel 246, a first hinge member 242, and a second hinge member 248. These additional portions cooperate to define a second compartment sized and configured to retain ice above the beverage containers in the first compartment. The side walls, end walls, handle panels, and hinge members of the cardboard sheet 200 are functionally equivalent to those described above with reference to the cardboard sheet 100 shown in FIG. 5.

A first fold line 290 separates the bottom wall 220 from the first side wall 221. A second fold line 291, which is parallel to the first fold line 290, separates the side walls 221 and 223 and end walls 225 and 227 from the handle panels 246 and 240 and hinge members 248 and 242, respectively. A third fold line 292, which is perpendicular to the first and second fold lines 290 and 291, separates the second side wall 223 and first handle panel 240 from the second end wall 227 and first hinge member 242, respectively. A fourth fold line 293, which is parallel to the third fold line 292, separates the second end wall 227 and first hinge member 242 from the first side wall 221 and second handle panel 246, respectively. The fourth fold line 293 also separates a first connecting flap 280 from the bottom wall 220.

A fifth fold line 294, which is parallel to the fourth fold line 293, separates the first side wall 221 and second handle panel 246 from the first end wall 225 and second hinge member 248, respectively. The fifth fold line 294 also separates a second connecting flap 281 from the bottom wall 220. A sixth fold line 295, which is parallel to the fifth fold line 294, separates a third connecting flap 254 from the second hinge member 248 and separates a fourth connecting flap 282 from the first end wall 225. A seventh fold line 296, which is parallel to the first fold line 290, separates a fifth connecting flap 283 from the bottom wall 220. An eighth fold line 297, which is parallel to the second fold line 291, extends across the handle panels 240 and 246 and the hinge members 242 and 248, intermediate the upper edges thereof and the second fold line 291.

After the sheet 200 has been folded along the fold lines 290–297, adhesive is applied to the exterior surfaces of the connecting flaps. The first connecting flap 280 interconnects the bottom wall 220 and the interior of the second end wall 227. The second connecting flap 281 interconnects the bottom wall 220 and the interior of the first end wall 225. The third connecting flap 254 interconnects the second hinge member 248 and the interior of the first handle panel 240. The fourth connecting flap 282 interconnects the first end wall 225 and the interior of the second side wall 223. The fifth connecting flap 283 interconnects the bottom wall 220 and the interior of the second side wall 223. The other interconnections between walls, hinge members, and handle panels are inherent in the integral nature of the sheet 200. The cardboard sheet 200 of FIG. 6 may be preferred over the cardboard sheet 100 of FIG. 5 to the extent that it requires one less fold line and four less connecting flaps to assemble the carton 100.

An alternative embodiment of the present invention is designated as 300 in FIG. 7. The carton 300 is similar to the preferred embodiment 100 to the extent that it likewise has a first compartment 308 sized and configured to snugly retain twelve twelve-ounce beverage cans 80 arranged side by side in a three by four array. However, this alternative embodiment carton 300 is laterally expandable, rather than upwardly expandable, to selectively provide a second compartment 309 for retaining ice 90 adjacent the beverage containers 80 in the first compartment 308.

At least one of the end walls 327 is secured in accordion-like fashion relative to the beverage retaining compartment 308. In particular, extended sidewalls, one of which is designated as 374, and extended top and bottom walls, one of which is designated as 377, extend from one end of the carton 300. The extended sidewalls are connected to additional side wall extensions, one of which is designated as 373, along common edges at respective fold lines, one of which is designated as 375. The extended top and bottom walls are connected to additional wall extensions, one of which is designated as 376, along common edges at respective fold lines, one of which is designated as 378.

Each corner between an adjacent side wall extension and top or bottom wall extension is formed by a folding hinge assembly 379 similar to those found on boxes of file folders sold under the trademark SMEAD. The extensions cooperate to form an expandable pocket that is moveable from a first, collapsed configuration, as shown on the far end 325 of the carton 300 in FIG. 7, to a second, expanded configuration 349 that provides an additional compartment 309 for ice 90, as shown on the near end 327 of the carton 300 in FIG. 7. A slit 399 is formed along an intermediate portion of the fold line 378 to facilitate passage of the ice 90 into the compartment 309. Those skilled in the art will recognize that other additional compartment or pocket arrangements and/or configurations may be used in implementing the present invention. For example, the side wall extensions 373 and 374 could be triangular in shape, with downwardly converging sides, in which case the cross-section of the resulting expanded pocket would be triangular rather than rectangular.

A pair of elongate slots are formed in the top wall 338 of the carton 300 to provide a handle 372. Adhesive strips 317 extend from the side walls, one of which is designated as 321, to the end walls 325 and 327 to releasably secure the pockets in a collapsed configuration until use of the expanded pocket is desired. Those skilled in the art will recognize that adhesive may alternatively be deposited between opposing walls, such as 373 and 374, to releasably secure the pockets in a collapsed configuration.

Another embodiment of the present invention is designated as 400 in FIG. 8. The carton 400 is similar to the other embodiments 100 and 300 to the extent that it likewise has a first compartment 408 sized and configured to snugly retain twelve twelve-ounce beverage cans 80 arranged side by side in a three by four array. Moreover, as on the carton 300, at least one of the end walls 427 is secured in accordion-like fashion to the beverage retaining compartment 408 of the carton 400. In particular, extended top wall 477 is connected to additional wall extension 476 along a common edge at fold line 478. In this embodiment 400, the end wall 427 travels outward from the first compartment 408 to form a second compartment 409 that is substantially open on one side when not covered by flap 417.

The opening 499 in the second compartment 409 is sized and configured to receive a coolant pack 92, as an alternative cooling source to ice cubes. The coolant pack 92 has an outer shell 93 that encloses a containment space 94. Removal of a cap 95 provides access to the containment space 94, so that the coolant pack 92 can be filled with a liquid and subsequently emptied of the liquid as desired. The filled coolant pack 92 is left in a freezer until needed, at which point it is simply inserted into the compartment 409 to provide a cooling source for the beverage containers 80. One of many suitable alternatives to the coolant pack 92 is a commercially available packet with chemical contents that undergo an endothermic reaction when manipulated.

An adhesive bearing flap 417 releasably secures the end wall 427 in a collapsed position. Subsequently, the flap 417 releasably covers the access opening 499 in the second compartment 409, as well as an access opening 497 in the first compartment 408, through which beverage containers 80 may be removed. When the carton 400 is positioned so that the end wall 427 faces the ground or other support surface, the cans 80 are accessible via the opening 497 and are proximate the coolant source 92 immediately prior to removal from the carton.

Figure 9:
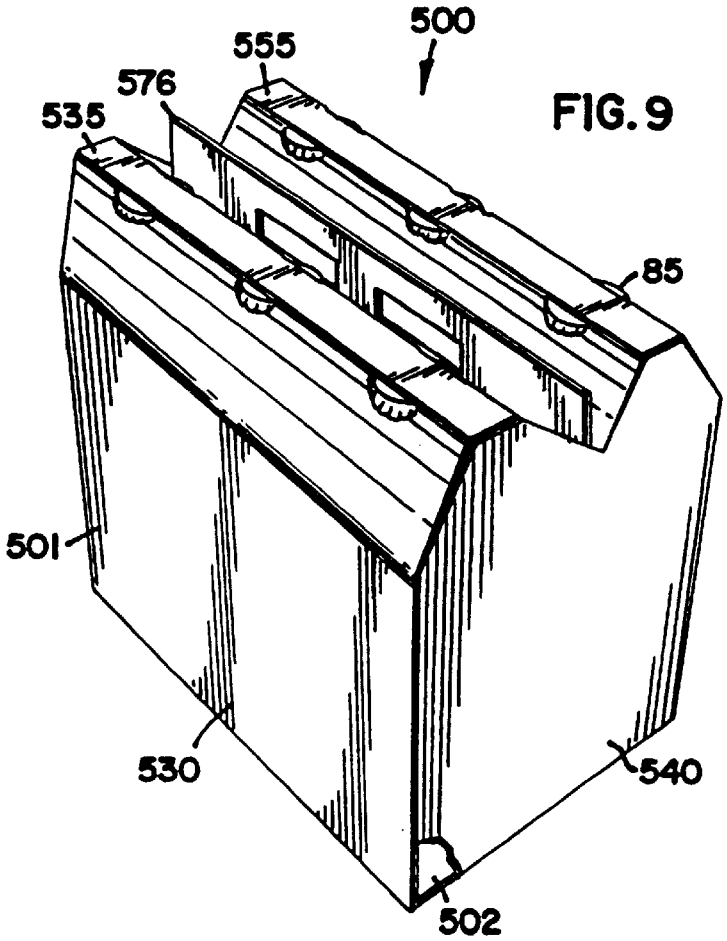
FIG. 9 is an isometric view of yet another carton constructed according to the principles of the present invention.
Figure 10:
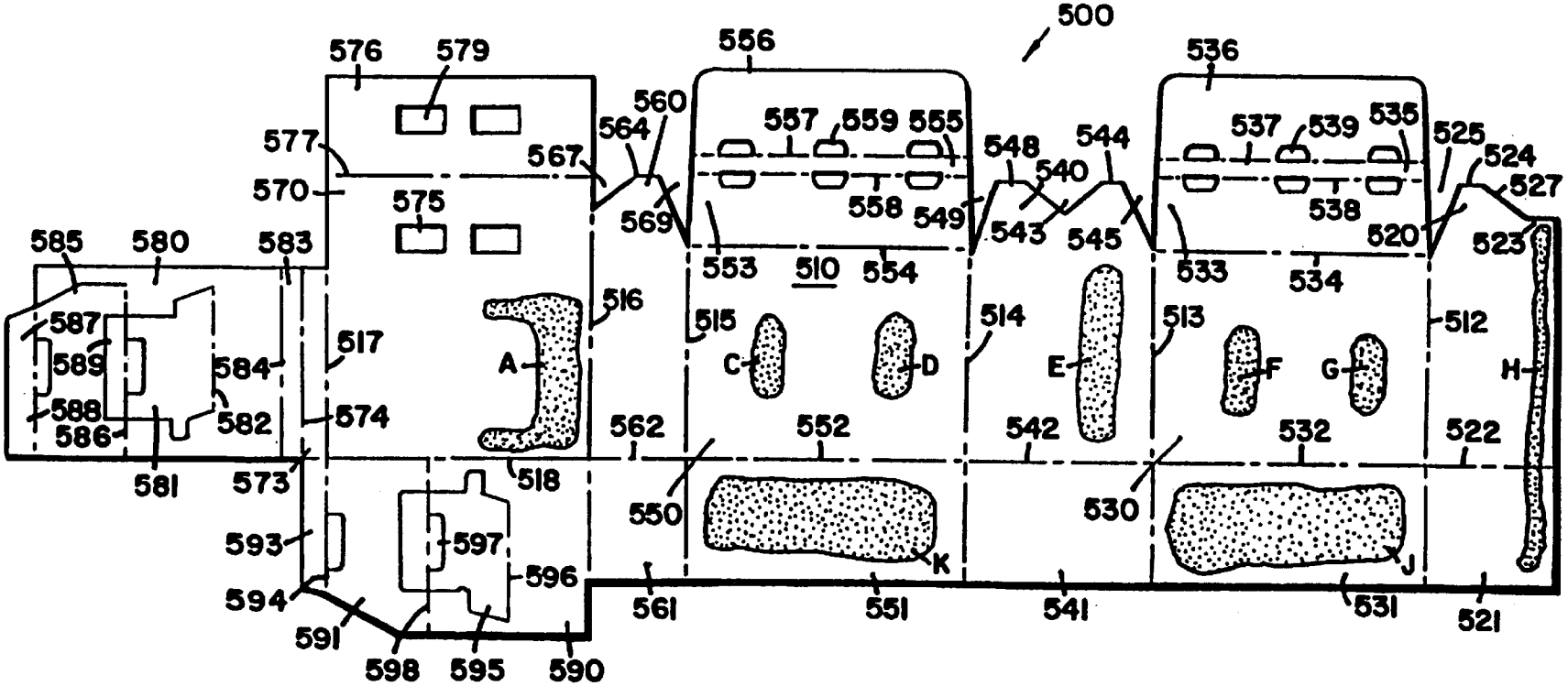
FIG. 10 is a plan view of a sheet of material that is manipulatable into the carton shown in FIG. 9.

Yet another carton constructed according to the principles of the present invention is designated as 500 in FIGS. 9–10. The carton 500 has an exterior surface 501 and an interior space 502 that is bounded by an interior surface 510. The carton 500 is assembled from a sheet of card stock paper shown in FIG. 10, wherein the solid internal lines designate cuts in the paper 500, and the broken internal lines designates folds of the paper 500. The interior surface 510 of the card stock paper 500 is coated with a water proof polymer that does not significantly hinder recycling of the paper. A suitable coating for this purpose is sold under the trademark PROTECOAT 3003 by NuCoat, LLC of Minneapolis, Minn.

The sheet of paper 500 includes portions which may be characterized as an end wall section 520, a side wall 530, an end wall 540, another side wall 550, another end wall section 560, an intermediate wall 570, a support panel 580, and another support panel 590. The end wall section 520 is generally rectangular in shape and integrally joins a first bottom flap 521 along fold line 522. The end wall section 520 extends laterally from a distal side portion 523 to a fold line 512 extending along a junction between the end wall section 520 and the first side wall 530. The end wall section 520 extends longitudinally from the bottom flap 521 up to a peak 524. A wedge-shaped notch 525 is cut between the peak 524 and the first side wall 530, and an angled edge 527 extends from an opposite side of the peak 524 downward and outward to the distal side portion 523.

The first side wall 530 is generally rectangular in shape and integrally joins a second bottom flap 531 along fold line 532. A line is cut between the first bottom flap 521 and the second bottom flap 531 to allow independent folding of the flaps. The first side wall 530 extends laterally from the fold line 512 to another fold line 513 extending along a junction between the first side wall 530 and the end wall 540. The first side wall 530 extends longitudinally from the bottom flap 521 up to an intermediate cover flap 533, a top flap 535, and a distal cover flap 536. The intermediate cover flap 533 is disposed between laterally extending fold lines 534 and 538; the top flap is disposed between lateral fold lines 538 and 537; and the distal cover flap 536 is disposed above the lateral fold line 537. Holes 539 are formed in the cover flaps 533 and 536 along opposite sides of the top flap 535. The cover flaps 533 and 536 are substantially mirror images of one another, so that when they are folded about respective fold lines 538 and 537, corresponding holes 539 in the cover flaps 533 and 536 align with one another.

The end wall 540 is generally rectangular in shape and integrally joins a third bottom flap 541 along fold line 542. A line is cut between the second bottom flap 531 and the third bottom flap 541 to allow independent folding of the flaps. The end wall 540 extends laterally from the fold line 513 to a fold line 514 extending along a junction between the end wall 540 and the second side wall 550. The end wall 540 extends longitudinally from the bottom flap 541 up to a pair of peaks 544 and 548 separated by a V-shaped notch 547 disposed therebetween. Wedge-shaped notches 545 and 549 are cut between respective peaks 544 and 548 and respective side walls 530 and 550. The notch 545 corresponds in size and configuration to the notch 525, and an edge of the notch 547 corresponds in size and orientation to the edge 527 on the end wall section 520.

The second side wall 550 is similar to the first side wall 530. In particular, the second side wall 550 is generally rectangular in shape and integrally joins a fourth bottom flap 551 along fold line 552. A line is cut between the third bottom flap 541 and the fourth bottom flap 551 to allow independent folding of the flaps. The second side wall 550 extends laterally from the fold line 514 to another fold line 515 extending along a junction between the second side wall 550 and the end wall section 560. The second side wall 550 extends longitudinally from the bottom flap 551 up to an intermediate cover flap 553, a top flap 555, and a distal cover flap 556. The intermediate cover flap 553 is disposed between lateral fold lines 554 and 558; the top flap is disposed between lateral fold lines 558 and 557; and the distal cover flap 556 is disposed above the lateral fold line 557. Holes 559 are formed in the cover flaps 553 and 556 on opposite sides of the top flap 555. The cover flaps 553 and 556 are substantially mirror images of one another, so that when they are folded about respective fold lines 558 and 557, corresponding holes 559 in the cover flaps 553 and 556 align with one another.

The end wall section 560 is generally rectangular in shape and integrally joins a fifth bottom flap 561 along fold line 562. A line is cut between the fourth bottom flap 551 and the fifth bottom flap 561 to allow independent folding of the flaps. The end wall 560 extends laterally from the fold line 515 to another fold line 516 extending along a junction between the end wall section 560 and the intermediate wall 570. The end wall 560 extends longitudinally from the bottom flap 561 up to a peak 564. Notches 567 and 569 are cut on opposite sides of the peak 564. The notch 567 corresponds in size and configuration to one-half of the notch 547, and the notch 569 corresponds in size and configuration to the notch 549.

The intermediate wall 570 is generally rectangular in shape. The intermediate wall 570 extends laterally from the fold line 516 to another fold line 517 extending along a junction between the intermediate wall 570 and the first support wall 580. The intermediate wall 570 extends longitudinally from another fold line 518 extending along a junction between the intermediate wall 570 and the second support wall 590, up to a distal handle portion 576. A fold line 577 extends along the junction between the distal handle portion 576 and the main body of the intermediate wall 570. Holes 579 are formed in the distal handle portion 576, and holes 575 are formed in the main body of the intermediate wall 570 in such a manner that the holes 575 and 579 align relative to one another when the distal handle portion 576 is folded about the fold line 577 and against the main body.

The first support wall 580 is generally rectangular in shape and extends laterally from the fold line 517 to a distal flap portion 587. The first support wall 580 extends longitudinally from a lower edge up to an upper edge. The first support wall 580 includes a first adjoining flap 573 disposed between the fold line 517 and another fold line 574 extending parallel to the fold line 517. The first support wall 580 further includes a second adjoining flap 583 disposed between the fold line 574 and another fold line 584 extending parallel to the fold line 574 along a juncture between the end flap 583 and the main body of the first support wall 580. A first transverse panel 581 is defined by a circuitous cut and fold line 582 in the first support wall 580. The first transverse panel 581 includes a generally T-shaped flap 589 defined by a substantially U-shaped cut and fold line 586 in the first support wall 580. The first transverse panel 581 and the flap 589 are folded relative to their respective fold lines 582 and 586 in such a manner that the interior side 510 of the first transverse panel 581 faces toward the fold line 517, and the interior side 510 of the flap 589 faces in the same direction as the interior side 510 of the first support wall 580.

A second transverse panel 585 is defined by outer edges of the first support wall 580, as well as a cut and fold line 586 in the first support wall 580. The second transverse panel 585 includes a generally T-shaped flap 587 defined by a substantially U-shaped cut and fold line 588 in the first support wall 580. The second transverse panel 585 and the second flap 587 are folded relative to their respective fold lines 586 and 588 in such a manner that the interior side 510 of the second transverse panel 585 faces toward the fold line 517, and the interior side 510 of the second flap 587 faces in the same direction as the interior side 510 of the first support wall 580.

The second support wall 590 is generally rectangular in shape and extends laterally from a distal end flap 593 to a cut between the second support wall 590 and the fifth bottom flap 561. The second support wall 590 extends longitudinally from a lower edge up to a fold line 518 extending along the juncture between the second support wall 590 and the intermediate wall 570. A first transverse panel 595 is defined by a circuitous cut and fold line 596 in the second support wall 590. The first transverse panel 595 includes a generally T-shaped flap 597 defined by a substantially U-shaped cut and fold line 598 in the second support wall 590. The first transverse panel 595 and the flap 597 are folded relative to their respective fold lines 596 and 598 in such a manner that the interior side 510 of the first transverse panel 595 faces away from the fold line 517, and the interior side 510 of the flap 597 faces in the same direction as the interior side 510 of the second support wall 590.

A second transverse panel 591 is defined by outer edges of the second support wall 590, as well as a cut along the fold line 518 between the second support wall 590 and the intermediate wall 570, and a fold line 598 in the second support wall 590. The second transverse panel 591 includes a generally T-shaped flap 593 defined by a substantially U-shaped cut and fold line 594 in the second support wall 590. The second transverse panel 591 and the second flap 593 are folded relative to their respective fold lines 598 and 594 in such a manner that the interior side 510 of the second transverse panel 591 faces away from the fold line 517, and the interior side 510 of the second flap 593 faces in the same direction as the interior side 510 of the second support wall 590.

A water resistant adhesive is used to secure the sheet 500 in a configuration suitable for holding a quantity of ice together with six bottles, as shown in FIG. 9. The adhesive is deposited in the region designated as A on the coated side 510 of the intermediate wall 570 and/or on a corresponding region on the second support wall 590. The second support wall 590 is folded about the fold line 518 and into contact with the region A, where it is secured adjacent the coated side 510 of the intermediate wall 570. The adhesive is also deposited on the opposite or uncoated side (not shown) of the intermediate wall 570 in a region that is an approximate mirror image of the region A and/or on a corresponding region on the first support wall 580. The adhesive is deposited on the uncoated sides of the adjoining flaps 573 and 583, as well. When the first support wall 580 is folded about the fold line 574 and toward the uncoated side of the intermediate wall 570, the adjoining flaps 573 and 583 are secured to one another, and the first support wall 580 is secured adjacent the uncoated side of the intermediate wall 570.

The adhesive is deposited on the uncoated side (not shown) of the distal handle portion 576. The distal handle portion 576 is then folded about the fold line 577 toward the uncoated side of the intermediate wall 570 and secured adjacent thereto by the adhesive. The adhesive is also deposited in the regions designated as C and D on the coated side 510 of the second side wall 550 and/or on the uncoated side of the flaps 593 and 597. The intermediate wall 570 is folded about the fold line 516 and toward the coated side 510 of the end wall section 560, which in turn, is folded about the fold line 515 and toward the coated side 510 of the second side wall 550. The uncoated side of the flap 593 is secured by the adhesive to the region D on the coated side 510 of the second side wall 550, and the transverse panel 591 extends substantially perpendicular between the intermediate wall 570 and the second side wall 550. The uncoated side of the flap 597 is secured by the adhesive to the region C on the coated side 510 of the second side wall 550, and the transverse panel 595 extends substantially perpendicular between the intermediate wall 570 and the second side wall 550.

The flaps 573 and 583 are folded about their respective fold lines 574 and 584 and toward the uncoated side of the intermediate wall 570. The adhesive is deposited in the region designated as E on the coated side 510 of the end wall 540 and/or on the coated side 510 of the flap 573. The second side wall 550 is folded about the fold line 514 and toward the coated side 510 of the end wall 540. The flap 573 is secured by the adhesive to the region E on the coated side 510 of the end wall 540, and the intermediate wall 570 extends substantially perpendicular from the end wall 540.

The adhesive is also deposited in the regions designated as F and G on the coated side 510 of the first side wall 530 and/or on the coated side 510 of the flaps 587 and 589. The end wall 540 is folded about the fold line 513 and toward the coated side 510 of the first side wall 530. The coated side 510 of the flap 587 is secured by the adhesive to the region G on the coated side 510 of the first side wall 530, and the transverse panel 585 extends substantially perpendicular between the intermediate wall 570 and the first side wall 530. The coated side 510 of the flap 589 is secured by the adhesive to the region F on the coated side 510 of the first side wall 530, and the transverse panel 581 extends substantially perpendicular between the intermediate wall 570 and the first side wall 530.

The adhesive is also deposited in the region designated as H on the coated side 510 of the first bottom flap 521 and the distal side portion 523 of the end wall section 520. The end wall section 520 and its associated bottom flap 521 are folded about the fold line 512 and toward the coated side 510 of the first side wall 530. The first bottom flap 521 overlaps a portion of the fifth bottom flap 562 and is secured to the uncoated side thereof by the adhesive in the region H. The distal side portion 523 overlaps the end wall section 560 and is secured to the uncoated side thereof, beneath the wedge-shaped notch 567, by the adhesive in the region H.

The first and fifth bottom flaps 521 and 561 are folded about their respective fold lines 522 and 562 toward the interior 502 of the carton 500. The third bottom flap 541 is also folded about its respective fold line 542 toward the interior 502 of the carton 500. The adhesive is deposited on the exposed, uncoated sides of these flaps 521, 561, and 541 and/or in the region designated as J on the coated side 510 of the second bottom flap 531. The second bottom flap 531 is folded about its respective fold line 532 and toward the interior 502 of the carton 500 and is secured relative to the flaps 521, 561, and 541 by the adhesive deposited therebetween. The adhesive is also deposited in the region designated as K on the coated side 510 of the fourth bottom flap 551, which is then folded about its respective fold line 552 and toward the interior of the carton 500 and is secured relative to the flaps 551, 521, 561, and 541 by the adhesive deposited therebetween. At this stage, the carton 500 has interconnected side walls, end walls, and bottom wall capable of containing ice and/or water.

Six bottles 85 are packaged within the interior space 502 of the carton 500. Adjacent bottles 85 are separated either by one of the transverse panels 581, 585, 591, or 595, or by the intermediate wall 570. Each of the top walls 535 and 555 is folded about a respective fold line 538 or 558 and rests on top of a series or row of three bottle caps. Each of the distal cover walls 536 and 556 is folded about a respective fold line 537 or 557 and opposite a respective intermediate cover wall 533 or 553. The holes 539 and 559 are disposed on opposite sides of a respective row of bottle caps, and the bottle caps protrude through the holes 539 and 559 and thereby retain the distal cover walls 536 and 556 in a closed position, as shown in FIG. 9.

Either or both of the distal cover walls 536 and 556 may be disengaged from a respective row of bottle caps to gain access to the interior space 502 for purposes of removing a bottle 85 or disposing ice within the carton 500. The handle portion 576 and an upper portion of the intermediate wall 570 extend upward between the two rows of bottles 85 and present openings 579 and 575. A person may conveniently lift and carry the carton 500 by placing one or more fingers through the openings 579 and 575.

Figure 11:
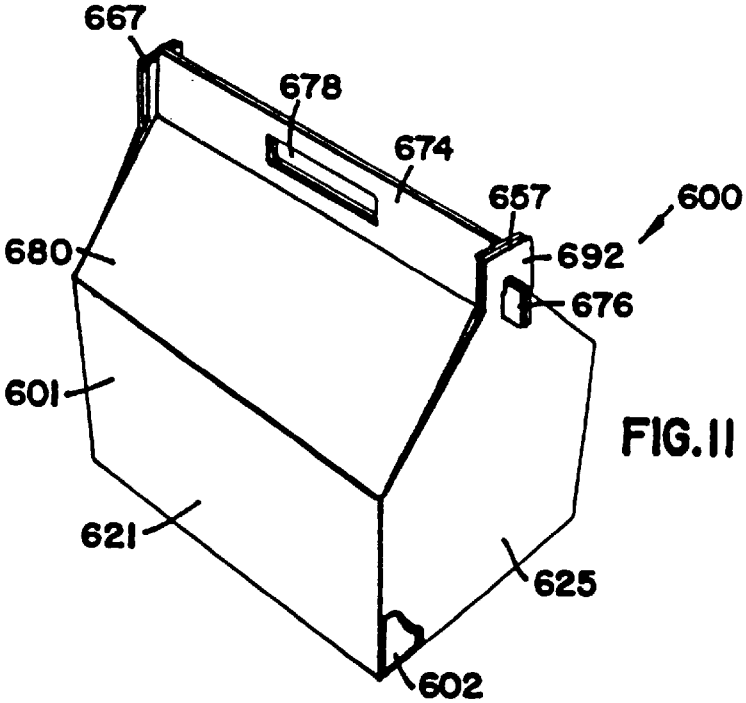
FIG. 11 is an isometric view of still another carton constructed according to the principles of the present invention.
Figure 12:
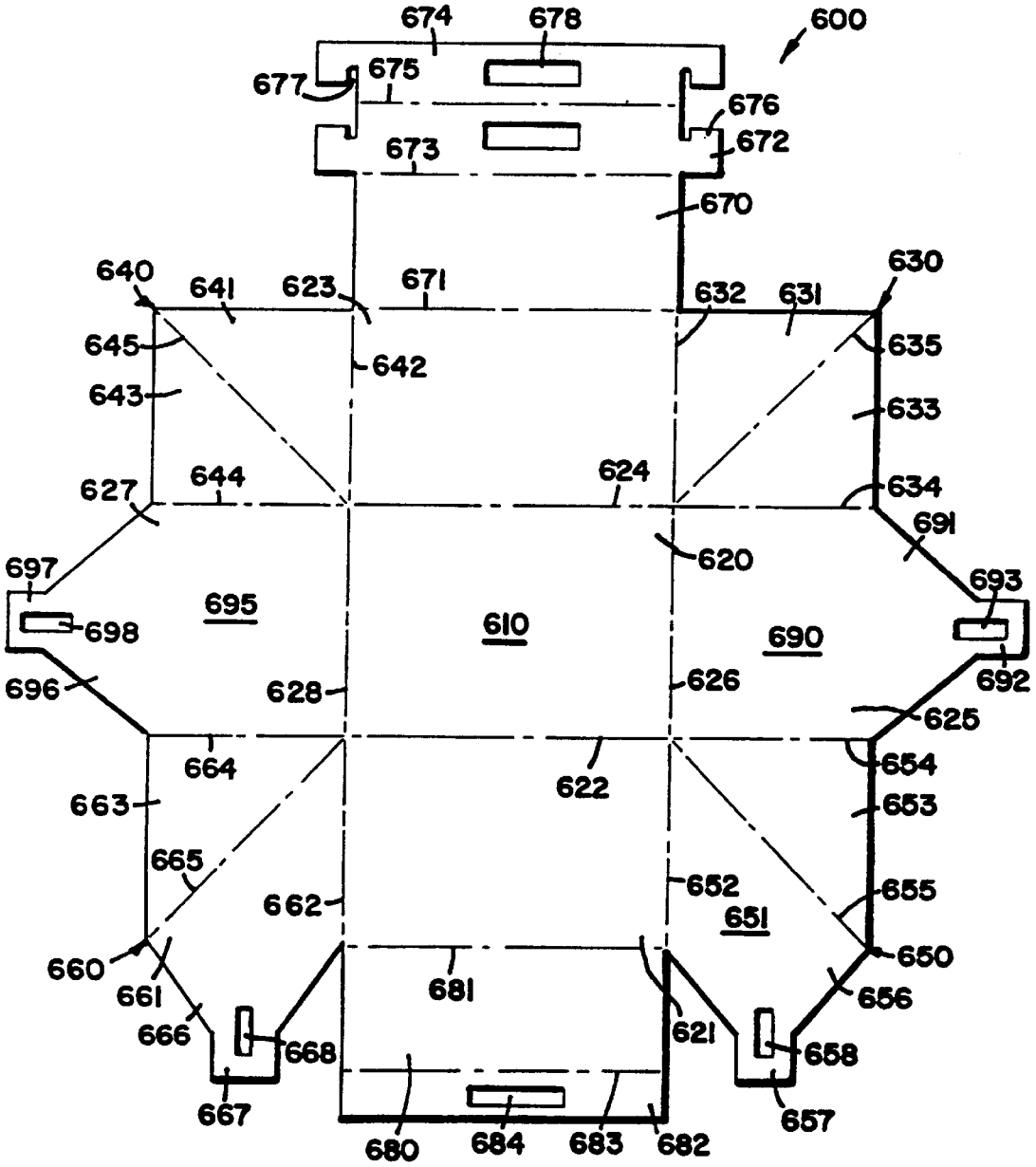
FIG. 12 is a plan view of a sheet of material that is manipulatable into the carton shown in FIG. 11.

Still another carton or cooler constructed according to the principles of the present invention is designated as 600 in FIGS. 11–12. Contrary to the previously described embodiments, the cooler 600 is not specifically designed to accommodate any particular item or items, such as a set of beverage containers. Rather, the cooler 600 is designed to be of a more universal nature, for keeping any suitably sized item below ambient temperature. Anticipated uses for the cooler 600 include short term storage and/or transportation of food, drink, and medicine. However, those skilled in the art will recognize other applications, as well.

The cooler 600 has an exterior surface 601 and an interior space 602 that is bounded by an interior surface 610. The cooler 600 is assembled from a sheet of corrugated cardboard designated as 600 in FIG. 12. The interior surface 610 of the cardboard 600 is coated with a water proof substance sold under the trademark PROTECOAT 3003 by NuCoat, LLC of Minneapolis, Minn. The paper 600 coated with this substance is disposable and repulpable.

The sheet of cardboard 600 includes portions which may be characterized as a bottom wall 620, a first side wall 621, a second side wall 623, a first end wall 625, and a second side wall 627. The bottom wall 620 and the first side wall 621 are integrally joined to one another along fold line 622. The bottom wall 620 and the second side wall 623 are integrally joined to one another along fold line 624. The fold lines 622 and 624 extend parallel to one another along opposite sides of the rectangular bottom wall 620. The bottom wall 620 and the first end wall 625 are integrally joined to one another along fold line 626. The bottom wall 620 and the second end wall 627 are integrally joined to one another along fold line 628. The fold lines 626 and 628 extend parallel to one another along opposite ends of the rectangular bottom wall 620, and perpendicular to the fold lines 622 and 624.

The side walls 621 and 623 are rectangular and similar to one another in size and configuration. The end walls 625 and 627 are also similar to one another in size and configuration. Each of the end walls 625 and 627 includes a substantially square portion 690 and 695 and a substantially triangular portion 691 and 696, respectively. Each of the triangular portions 691 and 696 has a base side that coincides with a side of a respective square portion 690 or 695 opposite the bottom wall 620, and a pair of equal length sides or edges that converge from the base toward a respective distal tab 692 or 697. A rectangular slot 693 or 698 is formed in each of the triangular portions 691 and 696 including portions of the tabs 692 and 697, respectively.

A first top wall 680 is integrally joined to the first side wall 621 along fold line 681. The first top wall 680 is generally rectangular in shape and extends from the first side wall 621 to a first handle flap 682, which is integrally joined to the first top wall 680 along fold line 683. The first handle flap 682 is generally rectangular in shape, and a rectangular slot 684 is formed through a central portion thereof.

A second top wall 670 is integrally joined to the second side wall 623 along fold line 671. The second top wall 670 is generally rectangular in shape and extends from the second side wall 623 to a second handle flap 672, which is integrally joined to the second top wall 670 along fold line 673. A third handle flap 674 is integrally joined to the second handle flap 672 along fold line 675, which extends parallel to the fold line 673. The third handle flap 674 is a mirror image of the second handle flap 672, relative to the fold line 675. The second and third handle flaps 672 and 674 are generally rectangular in shape, and a rectangular slot 678 is formed through a central portion of each. Substantially L-shaped members 676 extend from opposite ends of each of the second and third handle flaps 672 and 674 and toward the fold line 675, thereby defining gaps 677.

A first corner flap 630 integrally interconnects the first end wall 625 and the second side wall 623. The flap 630 includes a first portion 631 in the shape of a right isosceles triangle, and a second portion 633 in the shape of a right isosceles triangle similar in size and configuration to the first portion 631. A shorter side of the first triangular portion 631 is defined along fold line 632 at the junction between the second side wall 623 and the flap 630. The other shorter side of the first triangular portion 631 extends perpendicularly away from the second side wall 623. A shorter side of the second triangular portion 633 is defined along fold line 634 at the junction between the first end wall 625 and the flap 630. The other shorter side of the second triangular portion 633 extends perpendicularly away from the first end wall 625. The triangular portions 631 and 633 share a common hypotenuse along fold line 635 at the juncture therebetween. Thus, the triangular portions 631 and 633 cooperate to define a square corner flap 630, and the fold line 635 extends diagonally across the flap 630, from an exterior corner to an interior corner formed by the bottom wall 620, the second side wall 623, and the first end wall 625.

Similarly, a second corner flap 640 integrally interconnects the second end wall 627 and the second side wall 623. The flap 640 includes a first portion 641 in the shape of a right isosceles triangle, and a second portion 643 in the shape of a right isosceles triangle similar in size and configuration to the first portion 641. A shorter side of the first triangular portion 641 is defined along fold line 642 at the junction between the second side wall 623 and the flap 640. The other shorter side of the first triangular portion 641 extends perpendicularly away from the second side wall 623. A shorter side of the second triangular portion 643 is defined along fold line 644 at the junction between the second end wall 627 and the flap 640. The other shorter side of the second triangular portion 643 extends perpendicular away from the second end wall 627. The triangular portions 641 and 643 share a common hypotenuse along fold line 645 at the juncture therebetween. Thus, the triangular portions 641 and 643 cooperate to define a square corner flap 640, and the fold line 645 extends diagonally across the flap 640, from an exterior corner to an interior corner formed by the bottom wall 620, the second side wall 623, and the second end wall 627. The fold line 624 extends co-linearly between the fold line 644 and the fold line 634.

A third corner flap 650 integrally interconnects the first end wall 625 and the first side wall 621. The flap 650 includes a first portion 651 in the shape of a trapezoid, and a second portion 653 in the shape of a right isosceles triangle. The portions 651 and 653 are integrally joined to one another along fold line 655, which extends along the longer parallel side of the first, trapezoidal portion 651 and the hypotenuse of the second, triangular portion 653. The first, trapezoidal portion 651 includes a right isosceles triangle that is a mirror image of the second portion 653 relative to the fold line 655, as well as another portion 656 substantially in the shape of an isosceles triangle. One of the shorter sides of the mirror image triangular portion of the first, trapezoidal portion 651 coincides with a longer, base side of the triangular portion 656. The other shorter side of the mirror image triangular portion of the first, trapezoidal portion 651 is defined along fold line 652 at the junction between the first side wall 621 and the flap 650. The fold line 626 extends co-linearly between the fold line 652 and the fold line 632.

A shorter side of the second, triangular portion 653 is defined along fold line 654 at the junction between the first end wall 625 and the flap 650. The other shorter side of the second, triangular portion 653 extends perpendicularly away from the first end wall 625. The portions 651 and 653 cooperate to define a square corner flap 650 with the isosceles triangle 656 extending from an outer edge thereof. The shorter sides of the isosceles triangle 656 converge from opposite sides of the square corner flap 650 to a distal tab 657. A rectangular slot 658 is formed through a portion of the isosceles triangle 656 including a portion of the distal tab 657. The triangular portion 656, the tab 657, and the slot 658 are similar in size and configuration to the those of the first end wall 625.

Similarly, a fourth corner flap 660 integrally interconnects the second end wall 627 and the first side wall 621. The flap 660 includes a first portion 661 in the shape of a trapezoid, and a second portion 663 in the shape of a right isosceles triangle. The portions 661 and 663 are integrally joined to one another along fold line 665, which extends along the longer parallel side of the first, trapezoidal portion 661 and the hypotenuse of the second, triangular portion 663. The first, trapezoidal portion 661 includes a right isosceles triangle that is a mirror image of the second portion 663 relative to the fold line 665, as well as another portion 666 substantially in the shape of an isosceles triangle. One of the shorter sides of the mirror image triangular portion of the first, trapezoidal portion 661 coincides with the hypotenuse of the triangular portion 666. The other shorter side of the mirror image triangular portion of the first, trapezoidal portion 661 is defined along fold line 662 at the junction between the first side wall 621 and the flap 660. The fold line 628 extends co-linearly between the fold line 662 and the fold line 642.

A shorter side of the second, triangular portion 663 is defined along fold line 664 at the junction between the second end wall 627 and the flap 660. The fold line 622 extends co-linearly between the fold line 664 and the fold line 654. The other shorter side of the second, triangular portion 663 extends perpendicularly away from the second end wall 627. The portions 661 and 663 cooperate to define a square corner flap 660 with the isosceles triangle 666 extending from an outer edge thereof. The shorter sides of the isosceles triangle 666 converge from opposite sides of the square corner flap 660 to a distal tab 667. A rectangular slot 668 is formed through a portion of the isosceles triangle 666 including a portion of the distal tab 667. The triangular portion 666, the tab 667, and the slot 668 are similar in size and configuration to the those of the second end wall 627.

To arrive at the configuration shown in FIG. 11, the side walls 621 and 623 are folded about respective fold lines 622 and 624 so that the interior or coated side 610 of each face one another. Likewise, the end walls 625 and 627 are folded about respective fold lines 626 and 628 so that the interior or coated side 610 of each face one another. The corner flaps 630, 640, 650, and 660 fold about respective diagonal fold lines 635, 645, 655, and 665 in such a manner that the uncoated sides of each face one another, and the corner flaps are contained within the housing defined by the side walls 621 and 623 and the end walls 625 and 627. At this stage, the cooler 600 has interconnected side walls, end walls, and bottom wall capable of containing ice and/or water, as well as one or more objects to be cooled or kept cool. While the corner flaps are held against neighboring end walls, the object(s) and the ice are placed in the cooler and thereafter may function to maintain the corner flaps against the neighboring walls. The slots 658 and 668 through the corner flaps 650 and 660 align with the slots 693 and 698 through the end walls 625 and 627, respectively.

The end walls 625 and 627 are moved slightly away from one another to allow clearance therebetween for the top walls and the handle flaps. The first and second top walls 680 and 670 are folded about respective fold lines 681 and 671 and toward one another. The first and second handle flaps 682 and 672 are folded about respective fold lines 683 and 673 so that their coated sides 610 are parallel to and in contact with one another. The third handle flap 674 is folded about fold line 675 so that the coated side 610 of the third handle flap 674 is parallel to and in contact with the uncoated side of the first handle flap 682. At this stage, the first handle flap 682 is sandwiched between the second and third handle flaps 672 and 674. The overlapping pairs of L-shaped members 676 are inserted into slots 658 and 668 in respective corner flaps 650 and 660 and slots 693 and 698 in respective end walls 625 and 627. Portions of the corner flaps and the end walls immediately beneath the slots interengage or insert into the gaps 677 and thereby secure the cooler 600 in the configuration shown in FIG. 11. The aligned slots 684 and 678 in the handle flaps provide a means for conveniently lifting and carrying the cooler 600.

Figure 13:
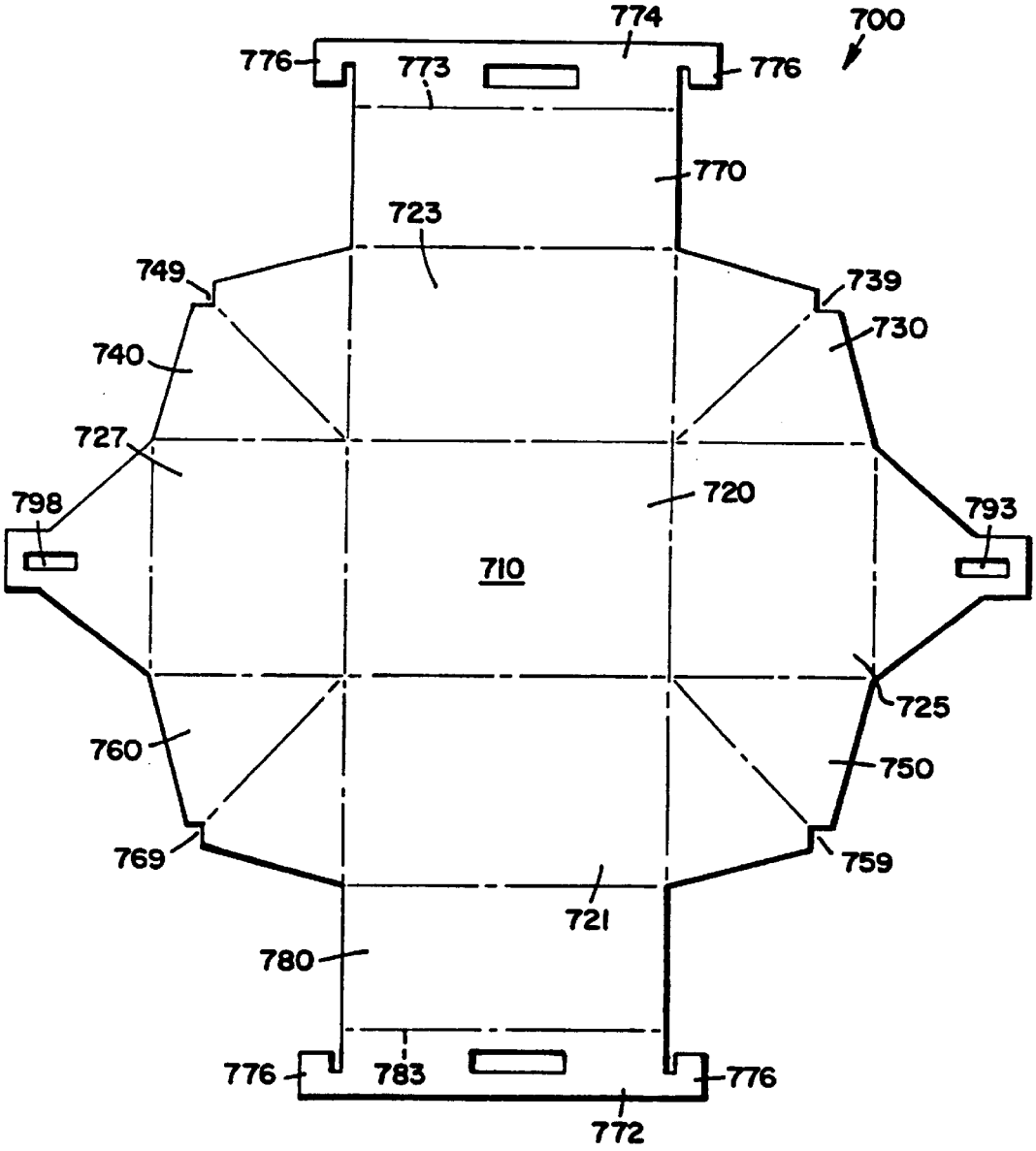
FIG. 13 is a plan view of another sheet of material which is manipulatable into a carton similar in external appearance to the carton shown in FIG. 11.

Another sheet of corrugated cardboard, from which a cooler similar to the foregoing embodiment 600 may be assembled, is designated as 700 in FIG. 13. The cardboard sheet 700 has an interior surface 710 and an opposite, exterior surface (not shown). The interior surface 710 is coated with a water proof substance sold under the trademark PROTECOAT 3003 by NuCoat, LLC of Minneapolis, Minn. Cardboard or paper coated with this substance is disposable and repulpable.

The sheet of cardboard 700 includes portions which may be characterized as a bottom wall 720, a first side wall 721, a second side wall 723, a first end wall 725, and a second end wall 727, all of which have similarly named and numbered counterparts on the carton 600 discussed above. The sheet of cardboard 700 likewise includes portions which may be characterized as a first top wall 780 and a second top wall 770, both of which have similarly named and numbered counterparts on the carton 600 discussed above.

The sheet of cardboard 700 further includes corner flaps 730, 740, 750, and 760, all of which are similarly shaped, and all of which are functionally similar to the corner flaps 630 and 640 on the carton 600 discussed above. Notches 739, 749, 759, and 769 are formed in respective distal corners of each of the corner flaps 730, 740, 750, and 760 and effectively square off these distal corners when the sheet 700 is manipulated into a carton similar to the carton 600 shown in FIG. 11.

The sheet of cardboard 700 does not include a first handle flap similar to that included on the carton 600. Rather, a handle flap 772 is connected to the first top wall 780, with a fold line 783 extending therebetween. Also, the sheet of cardboard 700 does not include a second handle flap similar to that included on the carton 600. Rather, a handle flap 774 is connected to the second top wall 770, with a fold line 773 extending therebetween. As a result of these changes vis-a-vis the carton 600, the sheet 700 is symmetrical about a reference line drawn through the slots 793 and 798 in the end walls 725 and 727, respectively.

Each of the handle flaps 772 and 774 includes L-shaped tabs or ears which extend away from opposite sides of each flap and then toward counterparts on the opposite flap. When the sheet 700 is manipulated into a carton, the handle flaps 772 and 774 abut one another, and adjacent ears 776 extend through each of the slots 793 and 798 to hold the carton together.

Although the present invention is described with reference to particular embodiments and applications, those skilled in the art will recognize that the present invention is not so limited. For example, the present invention is no less applicable to "six packs" or any other carton size or configuration other than the "twelve packs" shown herein. Also, the present invention is not limited to beverage containers or any particular type of beverage containers. The present invention is described with reference to a carton for cans simply because that particular carton size and configuration is common in the market place.

Those skilled in the art will further recognize that other types of materials and patterns could be used for cartons constructed and used according to the present invention. For example, many other forms of paper-based sheet products, including paper and cardboard, are suitable materials for constructing embodiments of the present invention. Also, many forms of cooling sources, including ice and endothermic chemical packets, are suitable materials for use in conjunction with embodiments of the present invention. Accordingly, the scope of the present invention is to be limited only to the extent of the appended claims.

What is claimed is:

1. A waterproof package, comprising;

a plurality of walls that interengage to form a package, the package having a rectangular parallelepiped-shaped first configuration enclosing a first volume suitable for snugly retaining a set of beverage containers for storage and shipment, and a second configuration where the plurality of walls enclose a second volume, the second volume including the first volume and an additional volume, wherein the package in the second configuration is adapted to retain and enclose the beverage containers and a quantity of ice proximate the set of beverage containers, and wherein the package in the second configuration comprises a carrying handle formed above the second volume; and a waterproof coating on one or more of the plurality of walls.

2. The package according to claim 1 wherein the waterproof coating is repulpable.

3. A method of making a carton for packaging beverage containers, comprising:

providing a sheet of paper, the sheet of paper having a waterproof coating on one or more sides;

folding the sheet of paper along a plurality of fold lines wherein the sheet has portions that interengage to retain the sheet in the form of a carton, the carton having a bottom, a pair of opposing end walls, and a pair of opposing sidewalls;

providing at least one enclosed expandable pocket on the carton; and providing a carrying handle opposite the bottom wherein the handle is formed by extensions of the opposing sidewalls.

4. The method according to claim 3, further comprising forming the carrying handle on an end of the expandable pocket.

5. The method according to claim 3, further comprising releasably securing the expandable pocket in a closed position relative to the carton to facilitate shipment of the carton.

6. The method according to claim 5, further comprising disposing beverage containers in the carton by positioning the beverage containers upright and side by side.

7. The method according to claim 5, wherein said bottom, said end walls and said sidewalls cooperate to retain water when the carton is properly oriented, and providing at least one expandable pocket on the carton is accomplished in a manner that allows a cooling source to be placed in fluid communication with the beverage containers.

8. A water resistant, cardboard carton for beverage containers comprising:

a rectangular, water resistant bottom having a perimeter;

a first water resistant side wall extending upward from a side of said bottom;

a second water resistant side wall extending upward from an opposite side of said bottom;

a first water resistant end wall extending upward from an end of said bottom, wherein said first end wall is segregated into a first upper portion and a first rectangular lower portion by a first fold line extending parallel to said bottom, wherein said first upper portion is substantially an isosceles triangle and defines a first slot;

a second water resistant end wall extending upward from an opposite end of said bottom, wherein said second end wall is segregated into a second upper portion and a second rectangular portion by a second fold line extending parallel to said bottom, wherein said second upper portion is substantially an isosceles triangle and defines a second slot;

a first water resistant corner flap connecting a side end of said first side wall to an adjacent side end of said first end wall, wherein an interior corner of said first corner flap, adjacent to said first side wall and to said first end wall, is bisected by a first fold line;

a second water resistant corner flap connecting an opposite side end of said first side wall to an adjacent side end of said second end wall, wherein an interior corner of said second corner flap, adjacent to said first side wall and to said second end is bisected by a second fold line;

a third water resistant corner flap connecting a side end of said second side wall to an adjacent side end of said first end wall, wherein an interior corner of said third corner flap, adjacent to said second side wall and to said first end, is bisected by a third fold line;

a fourth water resistant corner flap connecting an opposite side end of said second side wall to an adjacent side end of said second end wall, wherein an interior corner of said fourth corner flap, adjacent to said second side wall and to said first end, is bisected by a fourth fold line, and said side walls, said end walls, and said corner flaps cooperate with said bottom to define an open-ended, seamless, water resistant compartment in which the beverage containers are packaged; and a coolant storage means for storing a coolant proximate the beverage containers comprising:

a first water resistant top wall connected to an upper end of said first side wall;

a second water resistant top wall connected to an upper end of said second side wall;

a first handle flap connected to an upper end of said first top wall, and defining a first gap proximate a first side end of said first handle flap, and defining a second gap proximate a second side end of said first handle flap; and a second handle flap connected to an upper end of said second top wall, wherein said handle flaps fold toward one another and into contact, and said first upper portion folds towards said first side end of said first handle flap, and said first slot engages said first gap, and said second upper portion folds towards said second side of said first handle flap, and said second slot engages said second gap.

9. The carton according to claim 8 wherein the carton is repulpable.

10. A twelve-pack of beverage containers comprising a one-piece carton housing the beverage containers, the carton including a bottom, a pair of opposing end walls having end wall extensions, and a pair of opposing side walls having sidewall extensions, wherein the carton, in a first configuration, is fastened to provide a shippable, stackable carton where the end wall extensions and sidewall extensions cooperate with the bottom, the end walls, and the sidewalls to generally define three pairs of orthogonal sides, and in a second configuration, may be unfastened to release the end wall extensions and the side wall extensions to provide a volume above the beverage containers to receive ice, and in a third configuration, provides that the volume above the beverage containers may be enclosed with the sidewall extensions and the end wall extensions wherein the sidewall extensions define a one-handed handle above the carton.

11. The twelve pack of claim 10 further comprising a quantity of ice.

12. The twelve-pack of claim 10 wherein the carton further comprises a waterproof coating.

13. The twelve-pack of claim 12 wherein the waterproof coating is repulpable.

14. A method for transporting beverage containers comprising providing a one-piece package having a waterproof coating applied thereto, the package having a first, sealed configuration amenable to shipping the beverage containers and a second, open configuration providing access to the beverage containers within the package, and a third, closed configuration in which both the beverage containers and an additional volume are enclosed within the package, wherein a handle is provided above the beverage containers when the package is in the third, closed configuration.

15. A method for transporting beverage containers comprising:

providing a package having a waterproof coating applied thereto, the package having a first, sealed configuration amenable to shipping and a second, open configuration providing access to the package from above wherein a quantity of ice may be added, and a third, closed configuration enclosing the beverage containers and the quantity of ice wherein a handle is provided above the beverage containers and ice when the package is in the third, closed configuration;

adding the beverage containers; and adding the quantity of ice.

16. The method of claim 15 wherein the package and the waterproof coating are repulpable.

17. A method of shipping beer containers comprising:

providing a one-piece package, the package having a repulpable, waterproof coating applied to one or more portions;

loading a plurality of beer containers into the package;

sealing the package to define a first, sealed configuration amenable to shipping;

shipping the package to a retailer;

selling the package to a consumer;

unsealing the package to define a second, open configuration providing access to the package;

adding a quantity of ice to the package when the package is in the second, open configuration; and closing the package to define a third, closed configuration enclosing the beer containers and the ice.

18. The method of claim 17 further comprising providing a one-handed handle above the ice and beer containers, the handle adapted to carry the package in the third configuration.

19. A method of shipping beverage containers comprising:

providing a one-piece package, the package having a repulpable, waterproof coating applied to one or more portions;

loading a plurality of beverage containers into the package;

sealing the package to define a first, sealed configuration amenable to shipping;

shipping the package to a retailer;

selling the package to a consumer;

unsealing the package to define a second, open configuration providing access to the package;

adding a quantity of ice to the package when the package is in the second, open configuration; and closing the package to define a third, closed configuration enclosing the beverage containers and the ice.

20. The method of claim 19 further comprising providing a one-handed handle above the quantity of ice and the plurality of beverage containers, the handle adapted to carry the package in the third configuration.

21. An article, comprising:

a plurality of beverage containers;

a quantity of ice; and a unitary material portion comprising:

a bottom panel;

a pair of opposing end walls, each end wall defining a slot, the end walls interconnected with the bottom panel;

a pair of opposing sidewalls interconnected with the bottom panel and the end walls such that the bottom panel, sidewalls, and end walls enclose the beverage containers and the quantity of ice wherein at least one of the bottom panel, sidewalls, and end walls have a waterproof coating applied thereto; and a handle portion opposite the bottom panel comprising tabs positionable in each of the slots of the end walls.

22. The article according to claim 21, wherein the handle portion further comprises openings formed through the opposing sidewall extensions.

23. The article according to claim 22 wherein the waterproof coating is repulpable.

* * * * *

UNITED STATES PATENT AND TRADEMARK OFFICE

CERTIFICATE OF CORRECTION

PATENT NO.: 6,164,526

DATED: Dec. 26, 2000

INVENTOR(S) : Dalvey

It is certified that error appears in the above-identified patent and that said Letters Patent is hereby corrected as shown below:

In column 2, line 57, delete "First" and insert --first--, therefor.

In column 2, line 59, delete "Interior" and insert --interior--, therefor.

In column 5, line 60, insert --are-- before "configured".

In column 8, lines 12-13, delete "designates" and insert --designate--, therefor.

In column 15, line 8, delete "to the those" and insert --to those--, therefor.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*